United States Patent [19]

Morimoto

[11] 4,300,463

[45] Nov. 17, 1981

[54] NEEDLE THREADING DEVICE FOR SEWING MACHINES

[75] Inventor: Shuzo Morimoto, Hino, Japan

[73] Assignee: Janome Sewing Machine Co., Ltd., Tokyo, Japan

[21] Appl. No.: 171,419

[22] Filed: Jul. 22, 1980

[30] Foreign Application Priority Data

Jul. 27, 1979 [JP] Japan ..... 54-95041

[51] Int. Cl.[3] ..... D05B 87/02

[52] U.S. Cl. ..... 112/225

[58] Field of Search ..... 112/225, 224, 223, 270; 223/99

[56] References Cited

U.S. PATENT DOCUMENTS

| | | | |
|---|---|---|---|
| 1,059,641 | 4/1913 | Scranton | 112/225 |
| 2,544,577 | 3/1951 | Weber | 112/225 |
| 3,485,194 | 12/1969 | Eguchi | 112/225 |
| 3,517,631 | 6/1970 | Weber | 112/225 |
| 3,817,197 | 6/1974 | Bianchi | 112/225 |

*Primary Examiner*—H. Hampton Hunter

*Attorney, Agent, or Firm*—Michael J. Striker

[57] ABSTRACT

A needle threading device for sewing machines includes a thread guide which is pivotably mounted on a mounting plate parallel to the needle bar; a projection at the end of the thread guide is displaceable against the needle, and a thread inserting element operated by a pushbutton is slidably mounted for alignment with the thread guide to push the thread through the needle eye.

7 Claims, 9 Drawing Figures

NEEDLE THREADING DEVICE FOR SEWING MACHINES

BRIEF DESCRIPTION OF THE INVENTION

The invention relates to a needle threading device of simple structure for sewing machines, with which the thread can be easily and exactly passed through an eye of a needle, irrespectively of the straight stitching sewing machines or the zigzag stitching sewing machines.

There have been proposed various needle threading devices for sewing machines. However, such types of devices attached to the machine frame are in general large in size, and many of them are strictly limited in available range by a position of the needle to be threaded, and those are involved with problems in structure, operation and other respects. Even if those are simple in structure, a skilled experience is required, and this type also has problems in operation.

The present invention has been devised to eliminate all the problems of the prior art in order to realize each of the above mentioned purposes. It is a primary object of the invention to provide a device with which the thread can be easily passed through the eye of the needle. It is a second object of the invention to provide a device which can be applied not only to the straight stitching sewing machine moving the needle vertically only, but also to the zigzag stitching sewing machine giving the lateral amplitude movement to the needle. It is a further object of the invention to provide a device which can pass the thread through the eye of the needle at any stopping position of the sewing machine only if the needle is above the needle plate of the sewing machine. It is another object of the invention to provide a simple unit to be attached to the machine frame.

DETAILED DESCRIPTION OF THE INVENTION

Figure 1:
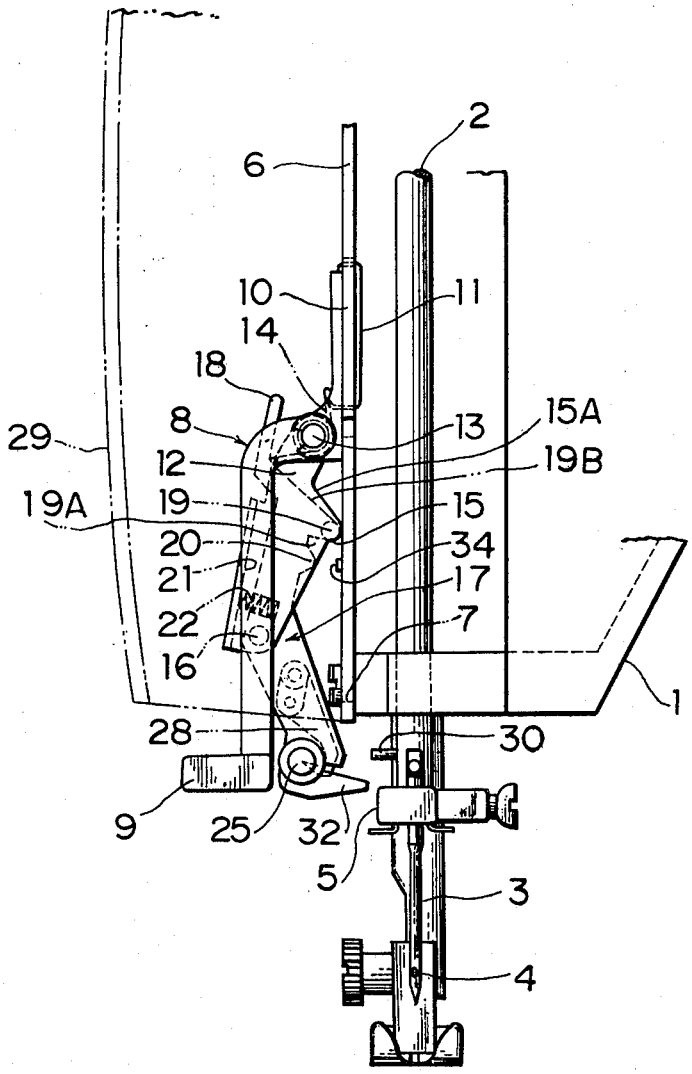
FIG. 1 is a front elevational view showing the instant device attached to the sewing machine in an upper inoperative position.
Figure 2:
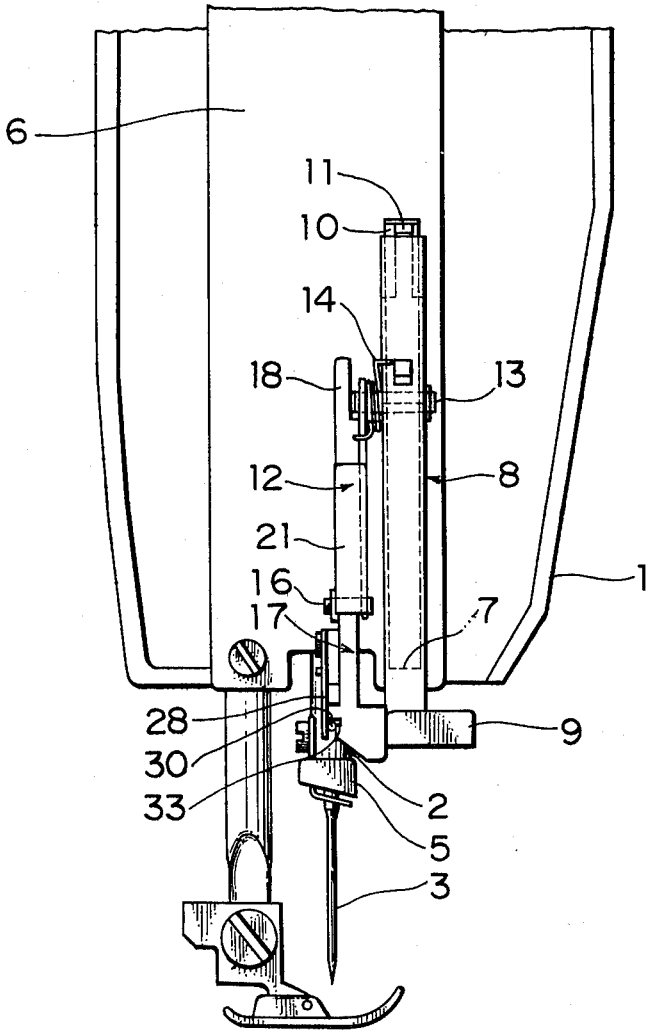
FIG. 2 is a side elevational view of the above.
Figure 4:
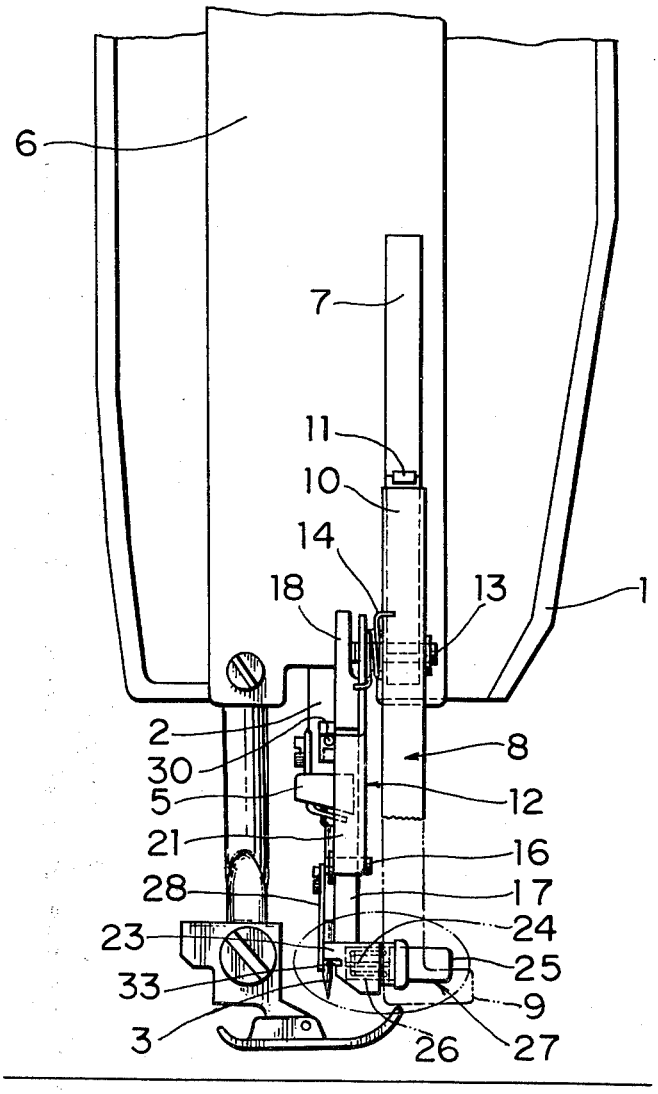
FIG. 4 is a side elevational view of the above.
Figure 4A:
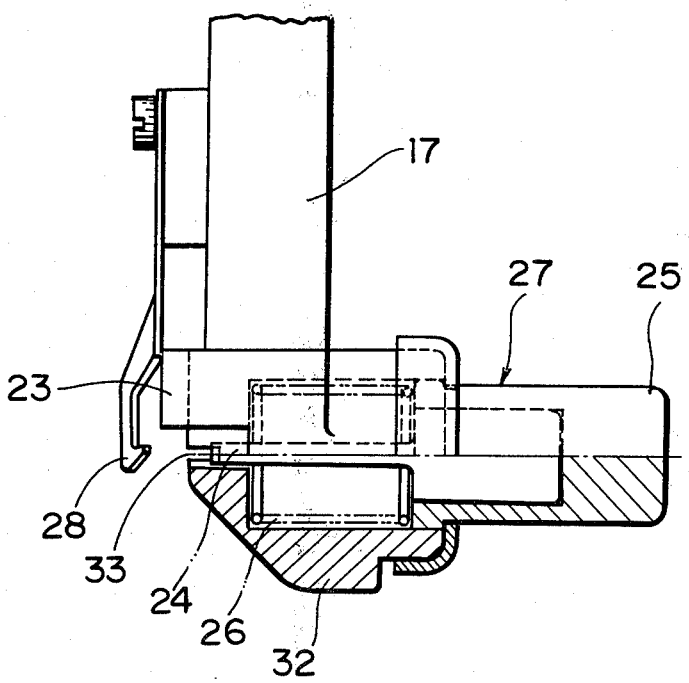
FIG. 4A is an enlarged view showing a part of FIG. 4.

The invention will be discussed with reference to the attached drawings. In reference to FIG. 1, a needle bar 2 is supported in a machine housing in such a manner that it is vertically reciprocated and laterally swingable in synchronism with rotation of an upper shaft (not shown). A needle 3 having a threading eye 4 is fixed by a needle clamp 5 to the lower end of the needle bar 2 in a condition that the threading eye faces to the machine operator. As shown in FIG. 2, a base plate 6 is fixed to the machine housing 1 vertically in parallel and adjacent to the needle bar 2. The plate 6 is formed with a vertical slot 7 in parallel to the axis of the needle bar 2 as shown in FIGS. 2 and 4. The slot 7 is engaged by a rectangular sliding part 10 of a slider 8 which is provided with a depending operating part 9 on one side of the base plate 6 as shown in FIG. 1. On the other side of the base plate 6, a holder plate 11 engages the sliding part 10 at the upper and lower ends thereof in such a manner that the two elements 10, 11 clamp the base plate 6. The holder plate 11 may be a leaf spring. Thus the slider 8 is slidable along the guide slot 7 of the base plate 6. An elongated support plate 12 is, at the upper end thereof, turnably mounted on the upper end of the depending operating part 9 of the slider 8 by a pin 13, and is biased in the counterclockwise direction in FIG. 1 by a spring 14 wound on the pivot pin 13, and the support plate 12 is, at a projection 15 thereof, pressed against the plate 6. As shown, the projection 15 is provided at the end of an inclined part 15A of the support plate 12.

Figure 3:
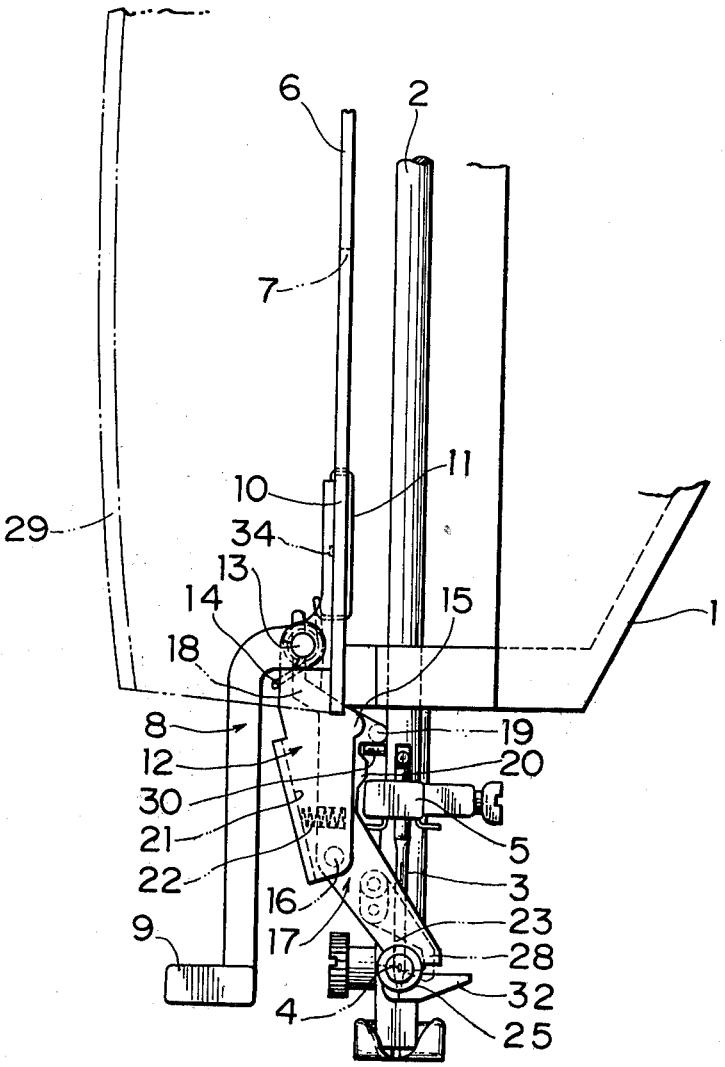
FIG. 3 is a front elevational view showing the present device in a lower operative position.
Figure 5:
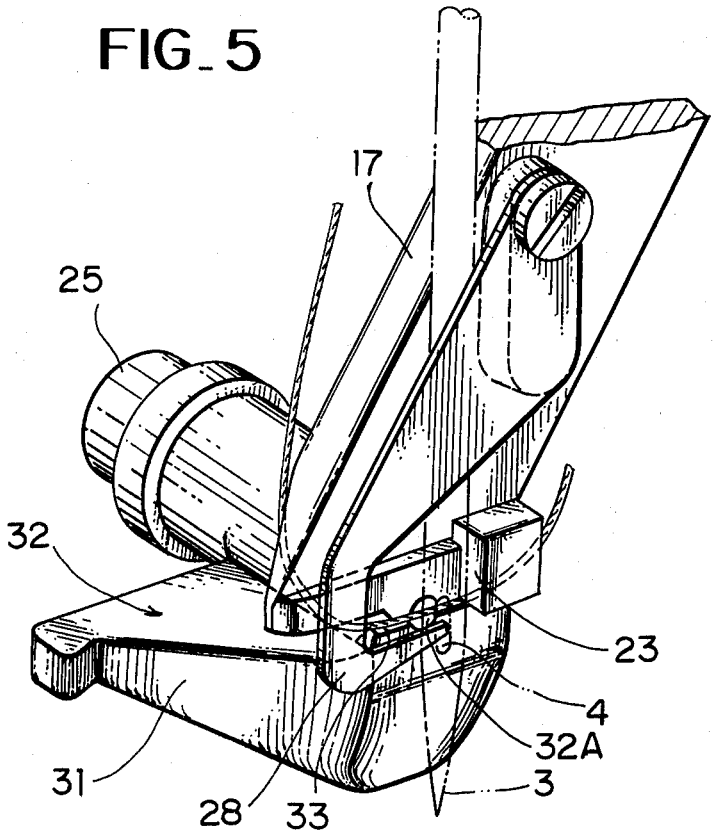
FIG. 5 is an enlarged perspective view showing a part of the invention.

At the lower end of the support plate 12, a thread guide 17 is turnable supported by a pin 16. The thread guide 17 is provided with an upwardly extending lever 18, and an inclined part 19B providing, at the end thereof, a projection 19 extending toward the base plate 6 which is just in alignment with the projection 15 of the support plate 12 when the device is in the upper inoperative position. The thread guide is also formed with a smaller projection 20 at a part below the projection to provide a recess 19A therebetween. A compression spring 22 is provided between one side of the thread guide 17 and an abutment 21 provided by a rearwardly bent part of the support plate 12 to bias the thread guide 17 in the clockwise direction in FIGS. 1 and 3. The thread guide 17 is provided at the lower and rear side thereof, with a projection 23 which is pressed against one side of the needle to position the threading device relative to the needle at the needle threading time as shown in FIGS. 3 and 5. In FIGS. 1, 3-5, a thread inserting element 27 is provided on the thread guide 17 at the lower side thereof. The thread inserting element 27 is provided with a push button 25 facing the operator and with a blade 24 extending axially and rearwardly within the threading guide 17. The blade 24 is forked at the free end thereof for engaging the thread which is to be passed through the needle eye 4. The push button 25 is normally biased toward the operator by a compression spring 26 arranged within the thread guide 17.

As shown in FIG. 5, a hook 28 is secured to the thread guide 17 on the left side of the positioning projection 23. The hook 28 is made of a thin elastic material, and is so arranged as to guide the positioning projection 23 exactly to the side of the needle.

Further, as shown in FIGS. 1, 3 and 5, the thread guide 17 is formed, at the lowest part thereof, with a laterally extending projection 32 which is provided, at the rear side thereof, with a face 31 inclined toward the operator to guide the thread to be inserted into the needle eye. The thread is guided to a horizontal groove 33 extending all through the thread guide 17 across a hole 32A through which the threading blade 24 passes, and between the guide projection 23 and the base of the lateral projection 32, as particularly shown in FIGS. 4 and 5.

The needle bar 2 is provided with a stopping pin 30 at its lower part for checking the down movement of the thread guide 17 and positioning the same with respect to the needle eye 4 (FIG. 1).

The slider 8 is held to the base plate 6 by the holding plate 11 of the spring material, and the springs 14, 22 press the aforementioned projections 15 and 19 against the plate 6 respectively. The threading device is also supported on the base plate 6 with the projection 19 getting over a checking projection 34 provided on the base plate 6 as shown in FIG. 1. Therefore the threading device will not be slipped down by vibration of the sewing machine in operation.

The instant device is of the above mentioned structure, which is attached to the plate 6 and is concealed by a cover 29 except the operating part 9.

The operation is as follows, if the machine operator pulles down the operating part 9, the threading device comes down along the vertical slot 7 of the base plate 6 from the upper inoperative position as shown in FIGS. 1 and 2. Accordingly the support plate 12 and the thread guide 17 come down together in the condition that the respective projections 15, 19 are pressed against the base plate 6, and the projections 15, 19 get over the checking projection 34 of the base plate 6. As the threading device is further pulled down, the projections 15, 19 come out of engagement with the base plate 6 at the lower end thereof. Then the support plate 12, on which the thread guide 17 is mounted, is turned in the counterclockwise direction in FIG. 1 by the torsion spring 14. Therefore the respective inclined parts 15A and 19B of the support plate 12 and the thread guide 17 engage the lower end of the base plate 6, and the support plate 12 and the thread guide 17 are shifted toward the needle 3 around the pivot pin 13 under the guide of the inclined parts 15A, 19B as these elements come down, and then the positioning projection 23 on the lower part of the thread guide 17 is guided by the hook 28 and the lower part of the thread guide 17, and engages one side of the needle 3 which has been brought up to a position in a predetermined region above the needle plate. Thus the lateral position of the threading device is determined relative to the needle eye 4.

As the threading device is further pulled down, the lower projection 20 of the thread guide 17 engages the laterally extending stop pin 30 of the needle bar 2. Then the thread guide 17 is turned in the counterclockwise direction around the pivot pin 16 against the compression spring 22, thereby to receive the stop pin in the recess 19A. Therefore, the upper projection 19 engages the stop pin 30 and prevents the threading device from coming down, thereby to stop the latter in the predetermined position. Thus the vertical position of the threading device is determined relative to the needle eye 4 as shown in FIGS. 3, 4 and 5. In this case, the needle 3 is positioned between the thread guide 17 and the hook 28, and the needle eye is in alignment with the hole 32A of the thread guide 17 through which the brade 24 of the thread element 27 passes through as shown in FIG. 5.

In this condition, the machine operator holds by the left hand the end of upper thread which is extended from the upper thread supplying source (not shown) through the thread take-up lever and the appropriate thread guide (not shown). Then the operator guides the thread to the inclined guide face 31 (in FIG. 5) at the rear side of the lower laterally extending part 32 of the thread guide 17, and pulls up the thread along the guide face 31. Then a part of the thread is guided into the horizontal groove 33 which is laterally extended across the hole 32A of the thread guide 17 through which the thread inserting blade 24 passes. Then, if the operator pushes the push button 25 of the thread inserting element 27 against the action of the compression spring 26, the blade 24 is moved in the rearward direction passing through the hole 32A and is inserted into the needle eye 4 which is in alignment with the hole 23A as shown in FIGS. 5 and 6(*a*), and therefore a part of the thread is inserted into the needle eye 4.

Figure 6A:
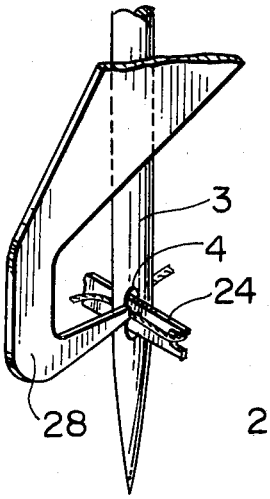
FIGS. 6A, 6B, 6C is a sequence of views showing the needle threading conditions.
Figure 6B:
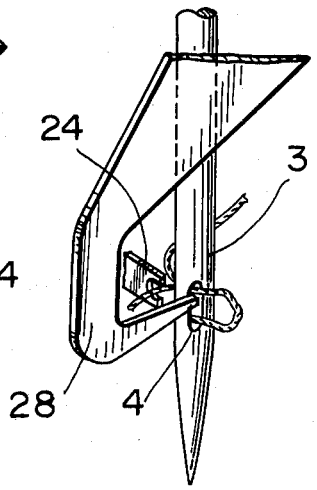
Figure 6C:
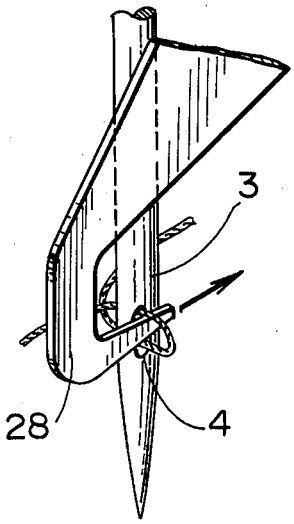

Then if the operator releases the push button 25, the blade 24 is retreated into the hole 32A by the action of the compression spring 26, and only the thread remains behind as it is inserted into the needle eye 4 as shown in FIG. 6(*b*) forming a loop substantially in a vertical plane on the rear side of the needle 3. Then, if the operator pushes up the threading device from the lower operating position as shown in FIGS. 3 and 4 to the upper inoperative position as shown in FIG. 1, the lower projection 20 of the thread guide 17 gets over the laterally extending stop pin 30 during the upper shifting process, and the thread guide 17 is turned together with the support plate 12 in the clockwise direction around the pivot pin 13 against the action of the torsion spring 14. Therefore, the hook 28 is inserted into the loop of the thread and pulls out the thread to the rear side of the needle. Thus the needle theading operation is finished, when the threading device is brought to the upper inoperative position as shown in FIG. 1, in which the device is again held against the base plate 6 by the friction spring 11 and by the torsion spring 14 which presses the support plate 12 against the base plate.

I claim:

1. A needle threading device for a sewing machine having a needle bar with a needle eye attached at the lower end thereof, said needle threading device moved between an upper inoperative position and a lower operative position in which said threading device is manually operated to pass a thread into the needle eye, comprising mounting means arranged adjacent to the needle bar; slide means mounted on the mounting means for sliding movement in a vertical direction, said sliding means having an operating part which is manually accessible: guide means turnably mounted on the slide means carrying an instrument manually operated to insert a thread into the needle eye from one side to the other side thereof; means cooperating with the needle in a predetermined position to determine a lateral position of the guide means relative to the needle eye during the downward sliding movement of the guide means from the inoperative position to the operative position; means cooperating with a part of the needle bar to determine a vertical position of the guide means relative to the needle eye during the sliding movement of the guide means from the inoperative position to the operative position; and hook means mounted on the guide means to draw out, on the other side of the needle eye, the thread inserted into the needle eye by the thread inserting instrument during the sliding movement of the guide means from the operative position to the inoperative position.

2. A needle threading device as defined in claim 1, further comprising an elastic holding element; said mounting means is a base plate formed with a vertical guide slot; said slide means is provided with a part engaging the slot of the base plate and engaged by the elastic holding element to frictionally hold the slide means on the base plate.

3. A needle threading device as defined in claim 1, further comprising a spring normally pressing the guide means against the mounting means to frictionally hold the threading device in the inoperative position, said spring displacing the guide means toward the needle when the threading device is shifted to the operative position.

4. A needle threading device as defined in claim 1, wherein said first mentioned positioning means is a projection provided on the guide means, said projection engaging one side of the needle when the threading device is in the operative position; said second mentioned positioning means is a recess formed in the guide means; and said part of the needle bar is a laterally extended pin secured to the needle bar, said pin engaging the recess when the threading device is in the operative position.

5. A needle threading device as defined in claim 1, wherein said manually operated thread inserting instrument comprises a spring biased push button and a blade for inserting a thread into the needle eye by operation of the push button.

6. A needle threading device as defined in claim 1, further comprising means for operating the hook means to draw out the thread inserted into the needle eye, said means comprising a projection on the guide means and a laterally extending pin secured to the needle bar, said projection getting over the pin during the movement of the guide means from the operative position to the inoperative position to turn the guide means in one direction.

7. A needle threading device as defined in claim 1, wherein said guide means is provided with a guide face to guide a thread to a position in which the thread is inserted into the needle eye by operation of the thread inserting instrument.

* * * * *